US011300286B2

(12) United States Patent
Pinkus et al.

(10) Patent No.: US 11,300,286 B2
(45) Date of Patent: Apr. 12, 2022

(54) AIR INFUSED STEAM GENERATOR

(71) Applicant: Atmos Project, LLC, Savannah, TN (US)

(72) Inventors: Michael J. Pinkus, Pleasantville, NY (US); Peter A. Titolo, Kings Park, NY (US)

(73) Assignee: ATMOS PROJECT, LLC, Savannah, TN (US)

( * ) Notice: Subject to any disclaimer, the term of this patent is extended or adjusted under 35 U.S.C. 154(b) by 0 days.

(21) Appl. No.: 16/897,385

(22) Filed: Jun. 10, 2020

(65) Prior Publication Data

US 2020/0400306 A1 Dec. 24, 2020

Related U.S. Application Data

(60) Provisional application No. 62/865,602, filed on Jun. 24, 2019.

(51) Int. Cl.

| | |
|---|---|
| ***F22B 35/10*** | (2006.01) |
| ***F22B 3/02*** | (2006.01) |
| *A61H 33/06* | (2006.01) |
| *F22B 33/18* | (2006.01) |

(52) U.S. Cl.

CPC ..... *F22B 35/10* (2013.01); *F22B 3/02* (2013.01); *A61H 33/065* (2013.01); *A61H 2033/068* (2013.01); *F22B 33/18* (2013.01)

(58) Field of Classification Search

CPC ..... A61H 33/065; A61H 33/068; F22B 1/28; F22B 3/02; F22B 35/10; F22B 33/18

See application file for complete search history.

(56) References Cited

U.S. PATENT DOCUMENTS

| | | | | |
|---|---|---|---|---|
| 4,325,906 | A * | 4/1982 | Kackos | A61L 2/24 422/26 |
| 4,997,030 | A * | 3/1991 | Goto | F24F 11/053 165/208 |
| 6,274,188 | B1 * | 8/2001 | Ledet | A23L 5/13 426/510 |
| 2017/0020782 | A1 * | 1/2017 | Pinkus | A61H 33/6052 |

FOREIGN PATENT DOCUMENTS

DE 20100427 U1 * 3/2001

OTHER PUBLICATIONS

Angelovska, Difference Between Pump and Compressor, Jun. 2018 (Year: 2018).*

* cited by examiner

*Primary Examiner* — Steven S Anderson, II
(74) *Attorney, Agent, or Firm* — Bradley Arant Boult Cummings; Phillip E. Walker

(57) ABSTRACT

Air infusing apparatus for generating air-infused steam. A mixer mixes air from a source of air with steam from a source of steam. An exhaust exhausts the mixed air and steam.

7 Claims, 5 Drawing Sheets

AIR INFUSED STEAM GENERATOR

FIELD OF THE INVENTION

This invention relates to steam generators and, more particularly, to steam generators used in steam baths, such as residential steam baths and steam bath enclosures, to generate air-infused steam that provides thicker and heavier steam.

BACKGROUND OF THE INVENTION

Steam generators, particularly residential steam bath steam generators, have long been known. Such steam generators may be thought of as permanently installed "tea kettles". Residential steam bath steam generators are connected to the residential household water supply system. A system of logic boards, sensors and solenoids in the steam generator maintains the water level as water is boiled off.

Typically, the steam generator is connected to a suitable source of energy, such as the household 240V electrical supply, which provides the energy for a heating element to boil the water which generates the steam. Steam is piped from the steam generator, which may be located in a vanity, attic, basement, or the like, to the steam room via field installed piping that terminates in a steam head. Typically, controls are provided to maintain a desired and safe temperature of the steam that is discharged.

In many cases, consumers prefer steam that is more visible. An appropriate description of such steam is "fluffy" steam. The visible appearance of such fluffy steam is steam that appears thicker and heavier than heretofore.

SUMMARY OF THE INVENTION

Therefore, the present invention is directed to a steam generator that generates and discharges into a steam bath enclosure, such as a residential steam bath, visible air-infused steam that is thicker, fluffier and heavier than steam which is generated without air infusion. The visual appearance of the discharged steam exhibits water droplets that are denser and/or larger than the water droplets in non-infused steam.

BRIEF DESCRIPTION OF THE DRAWINGS

The following detailed description will best be understood when read in conjunction with the accompanying drawings, in which.

DETAILED DESCRIPTION

Figure 1:
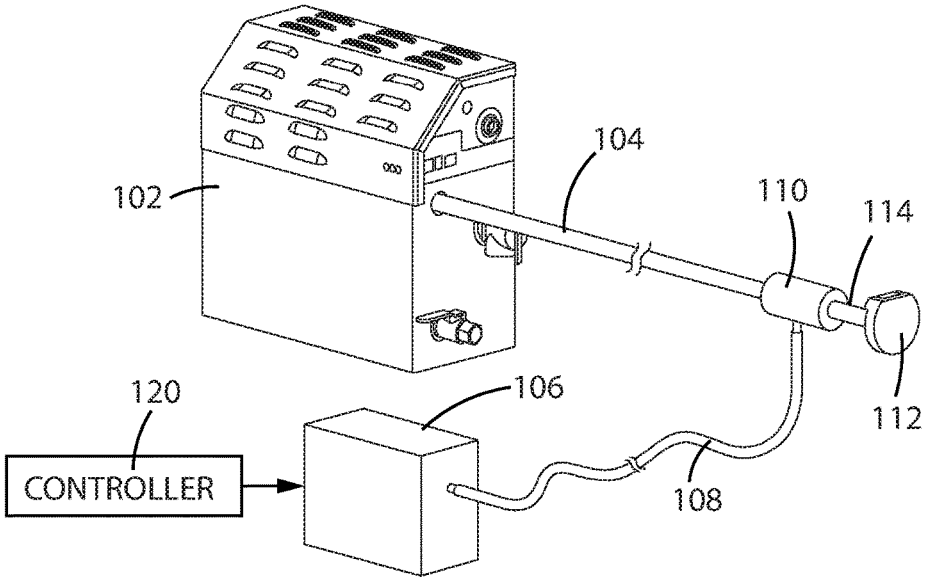
FIG. 1 illustrates one embodiment of the air infused steam generator in accordance with the present invention.

Referring now to the drawings, wherein like reference numerals are used throughout, FIG. 1 illustrates one embodiment of the air infused steam generator including a steam generator 102, an air source 106 and a mixing chamber 110. Steam generator 102 may be a conventional steam generator of the type known to those of ordinary skill in the art. One example of steam generator 102 is described in U.S. Pat. No. 10,105,283.

Steam generated by steam generator 102 is supplied via a steam conduit 104 to mixing chamber 110 at a pressure in the range of from 0 psi (atmospheric) to about 2 psi and at a flow rate in the range from about 15 lb/hr to about 45 lb/hr. The temperature of the supplied steam is 212° F. The mixing chamber receives air supplied thereto by an air conduit 108 from air source 106 and infuses, or mixes the air with the steam to generate air-infused steam. The air-infused steam is supplied from mixing chamber 110 via an exhaust conduit 114 to a steam head 112 at a temperature of about 183° F., from which the air-infused steam is exhausted into the steam bath enclosure.

In one embodiment, the air supplied to mixing chamber 110 from air source 106 is supplied under pressure preferably up to about 90 psi and at a flow rate of about 19 cubic feet per minute (CFM). Hence, air source 106 may be an air compressor, an air pump, any other conventional source of compressed air. In another embodiment, air supplied to the mixing chamber is simply ambient air at atmospheric or 0 psi supplied from the environment in which the air-infused steam system is located. The "fluffiness" of the air-infused steam generated by mixing chamber 110 is dependent, at least in part, on the amount, volume, flow rate or pressure of the supplied air.

A controller 120 may be coupled to air source 106 or, alternatively, to mixing chamber 110, to set or regulate the amount, volume, flow rate or pressure of the air infused to the steam. The setting established by controller 120 may be selectively adjusted by a user to establish the desired fluffiness of the air-infused steam. The controller may include circuitry that compares a user setting representing the amount, volume, flow rate or pressure of the air supplied to the mixing chamber, which determines the fluffiness, i.e. density and visibility of the steam, to the actual or measured amount, volume, flow rate or pressure of the supplied air. Differences between the user setting and the actual parameters may control a valve or other flow controller in the air supply apparatus to correspond to the user setting. As a result, the density and visibility of the air-infused steam may be set as desired by the user. Alternatively, the amount, volume, flow rate or pressure of the air supplied to the mixing chamber may be fixed and not adjustable by the user.

Figure 2:
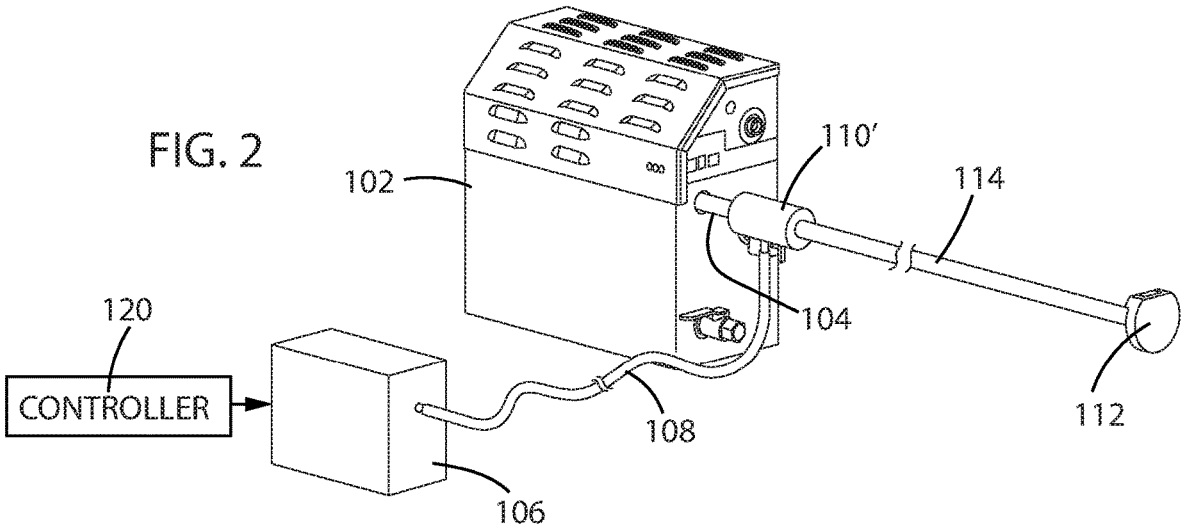
FIG. 2 illustrates another embodiment of the air infused steam generator in accordance with the present invention.

In the embodiment illustrated in FIG. 2, mixing chamber 110' is located at a shorter distance from steam generator 102 than is illustrated in FIG. 1. The location of the mixing chamber may have an impact on the fluffiness of the air-infused steam exhausted into the steam bath enclosure. In an alternative, the mixing chamber may be included in the steam generator, as by being integrated with or attached to the outlet pipe of the steam generator.

Figure 3:
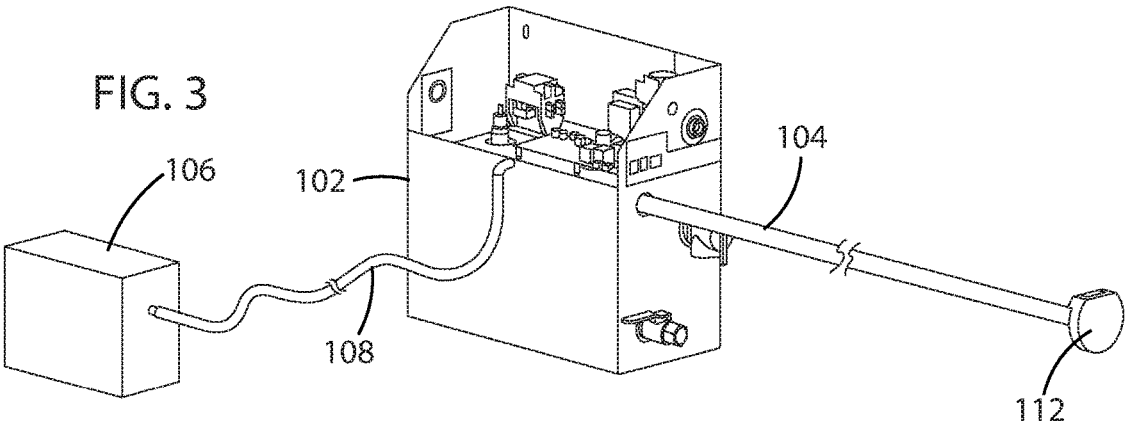
FIG. 3 illustrates a further embodiment of the air infused steam generator in accordance with the present invention.

In the embodiment illustrated in FIG. 3, the mixing chamber is not illustrated as an additional structure to which the steam from steam generator 102 is supplied. Rather, air from air source 106 is supplied by air conduit 108 directly into steam generator 102 which includes, as an integral unit, a mixing chamber. Additionally, the controller 120 illustrated in the embodiments of FIGS. 1 and 2 is omitted from the embodiment of FIG. 3. This represents that the use of a controller is optional.

Figure 4:
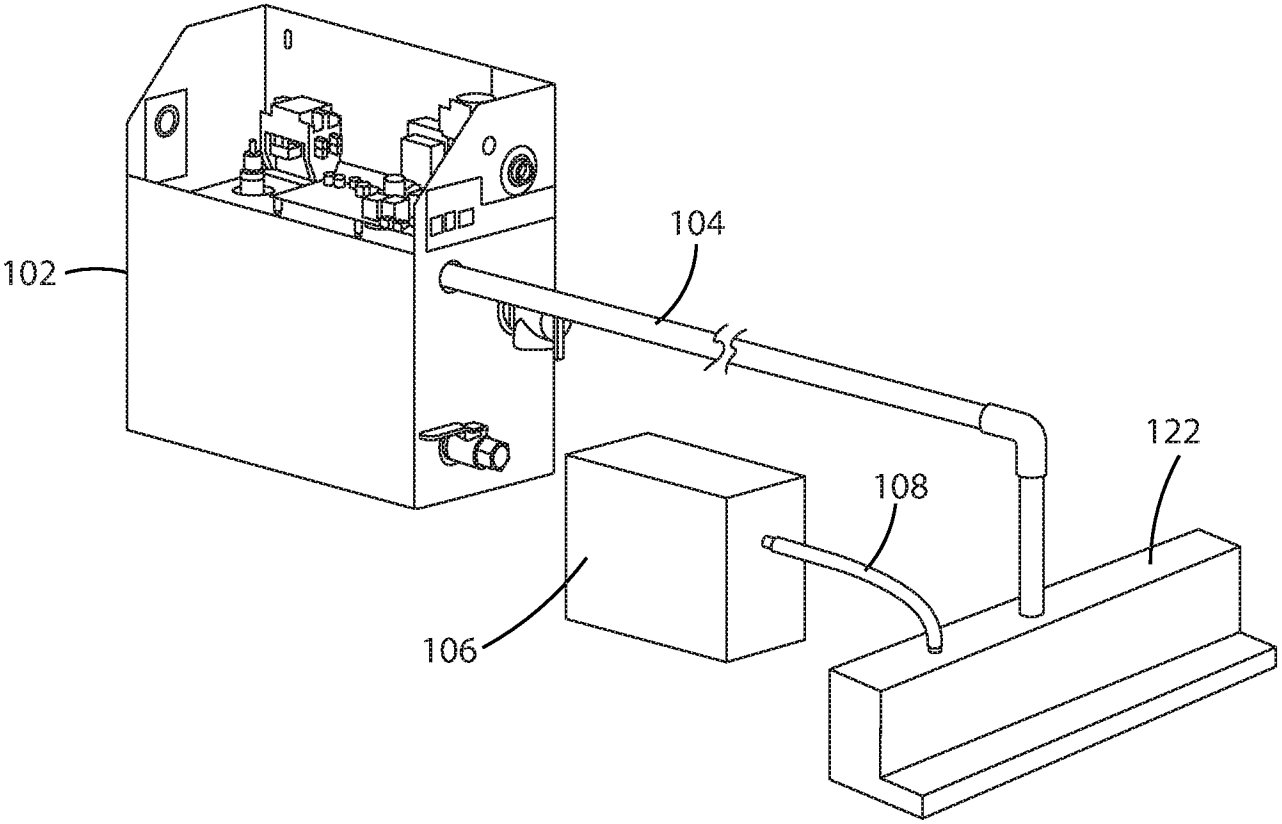
FIG. 4 illustrates yet another embodiment of the air infused steam generator in accordance with the present invention.

FIG. 4 illustrates another embodiment, wherein mixing chamber 110 is omitted. In this embodiment, air from air source 106 is supplied directly to steam head 122. Steam head 122 may be of the type described in U.S. Pat. No. 10,105,283 and includes one input to which steam conduit 104 is coupled and another input to which air conduit 108 is coupled. For example, steam head 122 includes a chamber having two inlets, one for receiving steam from steam conduit 104 and the other for receiving air from air conduit 108. The chamber infuses the steam received from steam conduit 104 with air received from air conduit 108.

Figure 5:
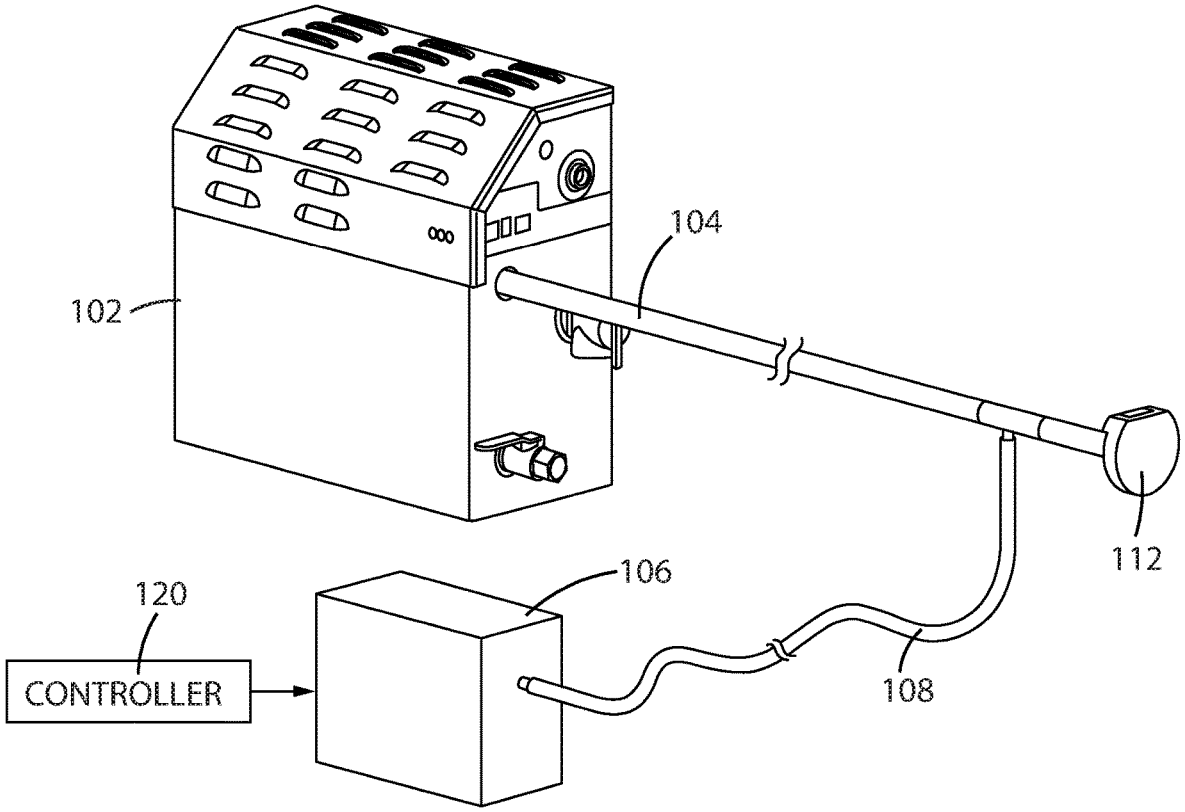
FIG. 5 illustrates yet another embodiment of the air infused steam generator in accordance with the present invention.

FIG. 5 illustrates another embodiment which omits mixing chamber 110. In this embodiment, air from air source 106 is introduced directly into steam conduit 104 for infusing the steam with air.

Figure 6:
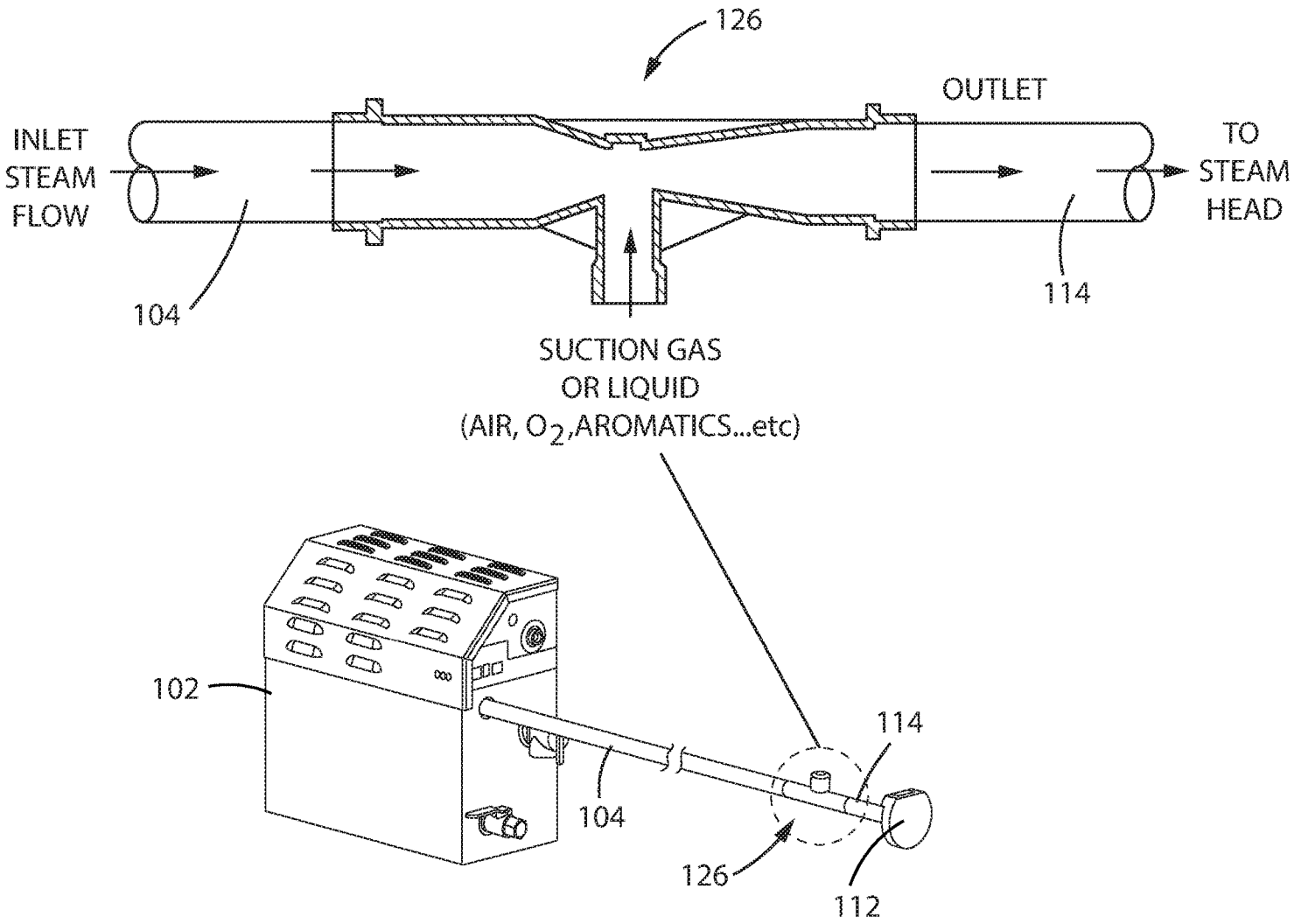
FIG. 6 illustrates an embodiment of a venturi device for infusing air into the steam generated a steam generator.

The Venturi principle may be employed to infuse air from the air source into the steam generated by steam generator 102. FIG. 6 illustrates a venturi injector device 126 disposed in steam conduit 104 for infusing steam from steam conduit 104 with air. The air may be supplied from air source 106, or from ambient air, such as from a location outside the room in which steam generator 102 is located. The venturi injector device may be a conventional venturi injector known to those of ordinary skill in the art, such as a Mazzei venturi injector. Air-infused steam is supplied from the outlet of the venturi injector device to steam head 112 via exhaust conduit 114.

FIG. 6 illustrates the supply of air to venturi injector device 126. Other gas, such as oxygen or oxygen-enriched air, may be supplied to the venturi injector device. In addition, a liquid, such as an aromatic, may be supplied to the venturi injector device, either alone or with the air, to produce steam with a desirable aroma or fragrance. It will be appreciated, such other gas or liquid, or a mixture of gas and liquid, may be supplied for mixing with the steam in the embodiments of FIGS. 1-5 such that the steam exhausted by the steam head 112 has the desired enrichment, aroma, and/or fragrance.

Figure 7:
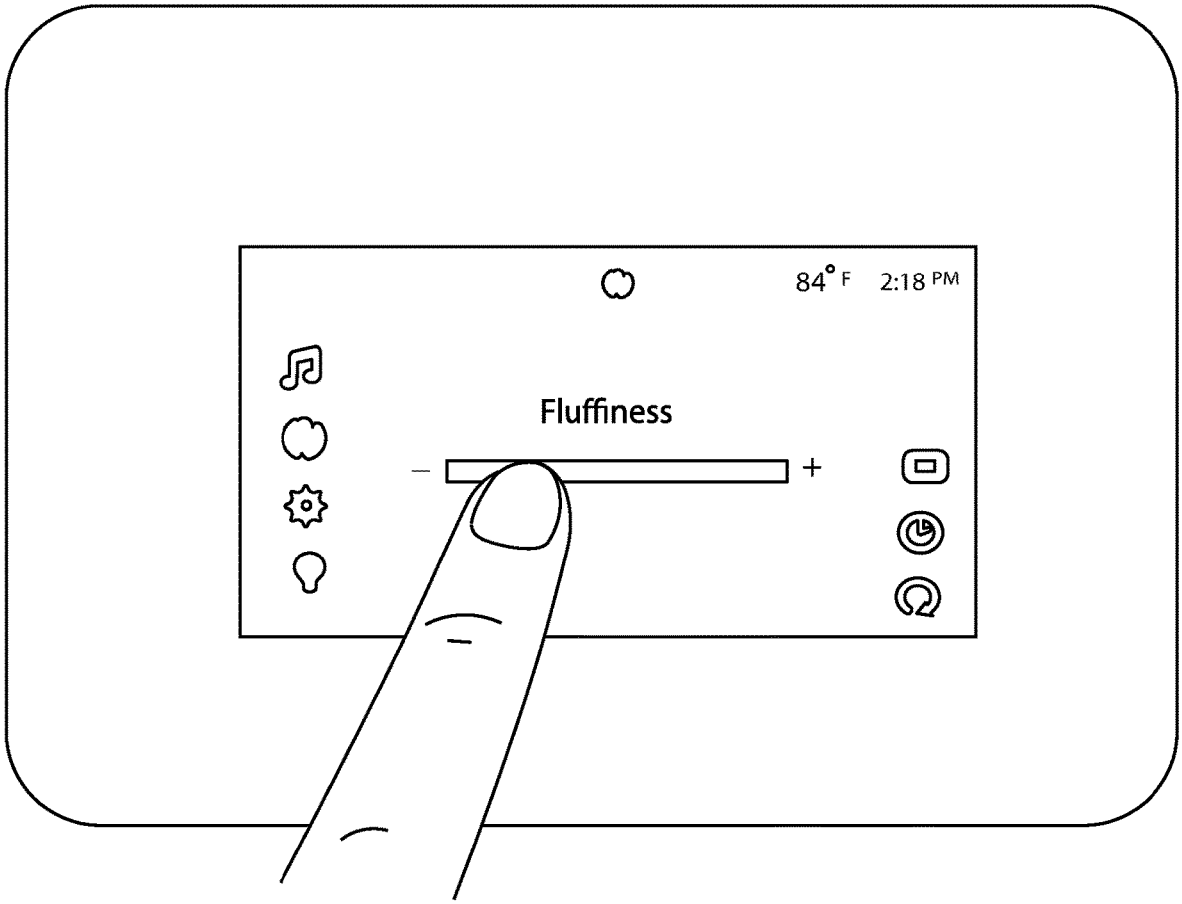
FIG. 7 illustrates a user interface that permits the user to set, maintain or regulate parameters of the air infused steam generated by the illustrated embodiments.

FIG. 7 illustrates a user interface for controlling the controller 120. The user interface of FIG. 7 includes a user-operated slide, such as a GUI slide, the setting of which determines, or sets, the amount, volume, flow rate or pressure of the air supplied by air source 106. This variation in the air supply, i.e., variation in the amount, volume, flow rate or pressure, may be set by the user to increase from (−), a relatively low level, to (+), a relatively higher level. The density, or fluffiness, of the air-infused steam increases with an increase in air supply. The user thus may set the particular fluffiness that he or she desires. Also, the amount of gas or liquid infused into the steam, such as in the embodiments shown in FIGS. 1-6, may be set or regulated by the user in response to a similar GUI slide or the like. Although not shown, suitable circuitry may be provided to set and regulate, or maintain, the amount, volume, flow rate or pressure of the air supplied by the air source in accordance with the setting by the user's operation of the interface illustrated in FIG. 7.

Alternatively, the user interface may comprise a rotary knob, or dial, operable to set the supply of the air supplied to the mixing chamber. Additionally, air from the air source may be supplied to the mixing chamber through a valve. The valve may be mechanically linked to the rotary knob and opened and closed in accordance with the operation of that knob. The valve thus may adjust the air supplied to the mixing chamber. As an alternative, the valve may be electrically controlled in response to the GUI slide shown in FIG. 7 to set the amount, volume, flow rate or pressure of the air supplied through the valve to the mixing chamber. It will be appreciated, the valve may be disposed in the mixing chamber.

The temperature of the air supplied by air source 106 may be ambient temperature, or increased or decreased relative to ambient. The effect of this air temperature on the density, visibility, or fluffiness of the air-infused steam exhausted from steam head 112 may be set by the user by setting, or controlling, the temperature of the supplied air. In one embodiment, air at ambient temperature, without adjustment, is supplied to the mixing chamber (FIGS. 1 and 2) or to the steam generator (FIG. 3) or to the steam head (FIG. 4) or to the steam conduit (FIG. 5) or to the venturi injector device (FIG. 6).

Mixing chamber 110 (or steam head 122) may include a device that generates a signal representing the fluffiness of the air-infused steam. For example, the fluffiness of the air-infused steam is related to the opacity of the steam, with less opacity representing steam that is fluffier. Accordingly, such a device may comprise a light meter that measures the intensity of light transmitted through the air-infused steam. As the fluffiness of the air-infused steam increases, the measured intensity of the light decreases. The amount, volume, flow rate or pressure of the air supplied by air source 106 may be set or controlled by the signal representing the intensity, or opacity, of the steam. In one embodiment, the light meter may be located downstream of the steam head 112, i.e., within the steam bath enclosure. In another embodiment, the light meter maybe located in exhaust conduit 114. The signal generated by the light meter may be used as a feedback signal representing the fluffiness of the air-infused steam which, in turn, is used by controller 106 to set, regulate or maintain the pressure of the air generated by the air compressor or air pump.

While the present invention has been shown and described with reference to certain preferred embodiments, it will be appreciated that various changes in form and details may be made, without departing from the spirit and scope of the invention. Some of those alternatives have been described. Others will be apparent. It is intended the appended claims be interpreted to cover the embodiments described herein as well as such other changes, modifications and variations that fall within the scope of the appended claims.

What is claimed is:

1. Air infusing apparatus for generating air-infused steam, comprising:

a source of steam;

a source of air for supplying air to be mixed;

a user-operable interface for setting a parameter of the air to be mixed;

a controller coupled to the source of air for regulating the parameter of the air to be mixed;

a mixer for mixing the air and the steam;

an exhaust for exhausting the mixed air and steam;

a sensor disposed to measure opacity of the exhausted air and steam and generate a signal representing the measured opacity, the signal being supplied to the controller, wherein the controller regulates the parameter of the air to be mixed as a function of the generated signal.

2. The air infusing apparatus of claim 1, wherein the source of air is an air compressor.

3. The air infusing apparatus of claim 1, wherein the source of air is an air pump.

4. The air infusing apparatus of claim 1, wherein the user-operable interface includes a user-operable slide.

5. The air infusing apparatus of claim 1, wherein the user-operable interface includes a knob.

6. The air infusing apparatus of claim 1, further comprising a valve for coupling the air from the source to the mixer; and wherein the controller controls the valve to set the parameter of the supplied air to be mixed.

7. The air infusing apparatus of claim 1, wherein the mixer comprises a steam head for receiving the air whose parameter has been regulated and the steam, the steam head exhausting the mixed air and steam.

* * * * *